US005233325A

United States Patent [19]

Takeda

[11] Patent Number: 5,233,325

[45] Date of Patent: Aug. 3, 1993

[54] THERMOSTAT WITH FILMY HEATER

[75] Inventor: Hideaki Takeda, Saitama, Japan

[73] Assignee: Uchiya Thermosatat Co., Saitama, Japan

[21] Appl. No.: 862,290

[22] Filed: Apr. 1, 1992

[30] Foreign Application Priority Data

Apr. 5, 1991 [JP] Japan ..... 4-72940

[51] Int. Cl.[5] ..... H01H 61/02

[52] U.S. Cl. ..... 337/107; 337/102

[58] Field of Search ..... 337/102, 103, 104, 105, 337/106, 107; 29/511

[56] References Cited

U.S. PATENT DOCUMENTS

| | | | |
|---|---|---|---|
| 3,453,577 | 7/1969 | D'Entremont | 337/89 |
| 3,593,248 | 7/1971 | Shepherd et al. | 337/107 |
| 4,862,132 | 8/1989 | Hollweck | 337/102 |

FOREIGN PATENT DOCUMENTS

| | | |
|---|---|---|
| 0102574 | 3/1984 | European Pat. Off. . |
| 0272696 | 6/1988 | European Pat. Off. . |
| 0345195 | 12/1989 | European Pat. Off. . |
| 3128090A1 | 4/1982 | Fed. Rep. of Germany . |
| 62-31851 | 2/1987 | Japan . |
| 62-31852 | 2/1987 | Japan . |
| 61-16582 | 7/1987 | Japan . |
| 62-111154 | 7/1987 | Japan . |
| 63-25638 | 7/1988 | Japan . |
| 63-501833 | 7/1988 | Japan . |
| 1-12669 | 4/1989 | Japan . |
| 1-105430 | 4/1989 | Japan . |
| 1-246737 | 10/1989 | Japan . |

*Primary Examiner*—Harold Broome
*Attorney, Agent, or Firm*—Nixon & Vanderhye

[57] ABSTRACT

A thermostat including a heater without a positive temperature characteristic thermistor or an alumina substrate. The thermostat with a filmy heater includes two terminals (2*a*, 3*a*) to be connected with an external circuit, a fixed plate (2) connected with one of said terminals and on which a static contact point (2*b*) is mounted, a resilient plate (3) connected with the other of the two terminals and on which a movable contact point (3*b*) is mounted, a bimetal (5) which is so deformed, when temperature of the bimetal exceeds a predetermined temperature, to deform the resilient plate so that the movable contact point is separated from the static contact point, and heater (6) mounted in parallel with said fixed plate and the resilient plate. The heater is an electro-conductive film (6*a*) on an insulative film (6*b*), which is incorporated in the thermostat.

2 Claims, 3 Drawing Sheets

FIG. 6 *(PRIOR ART)*

THERMOSTAT WITH FILMY HEATER

FIELD OF THE INVENTION AND RELATED ART STATEMENTS

The present invention relates to a thermostat including a bimetal having a contact, which opens and closes in response to a temperature and a heater for heating the bimetal when the contact is opened.

The thermostat serves to open or close contacts, by deforming the bimetal, when the temperature of the bimetal rises due to any trouble in an electrical appliance.

Once the bimetal is operated, a current in a load stops, and also the heat generation in the load stops. Consequently, in a simple thermostat, the temperature of the bimetal decreases and a current begins to flow through the load again. This is very dangerous. And it is necessary to prevent such a situation. The present invention relates to a thermostat with a heater, where a heater is connected in parallel with the thermostat, as shown in FIG. 6. The heater heats the bimetal, until the power supply P.S is turned off, to maintains the current stop in the load L.

As a heater for the thermostat of this type, using a positive temperature characteristic thermistor (PTC) is disclosed in, for example, Japanese Patent Provisional Publication Nos. 62-165824 and 1-105430 and Japanese Utility Model Publication Nos. 63-25638 and 1-12669 and Japanese Utility Model Provisional Publication No. 62-111154.

An over-load protection apparatus, incorporating an S-shaped resistor as a heater, is disclosed in Japanese Utility Model Provisional Publication Nos. 62-31852 and 62-31851.

A thermal switch including a heater made of conductive plastic base is disclosed in Japanese Patent Provisional Publication No. 1-246737.

Further, a bimetal type thermostat, using an alumina ceramic substrate having a thin film resistor on its lower surface, is disclosed in Japanese Patent Provisional Publication No. 63-5018833.

On the other hand, as a material for a flexible printed circuit board, polyimide film, which can be obtained by contraction polymerization of aromatic tetrachloride acid and aromatic diamine, became commercially available and began to be used, under the trademark "CAPTON". This material possesses stable electrical and mechanical characteristics in a wide temperature range.

OBJECT AND SUMMARY OF THE INVENTION

The characteristic of the positive temperature characteristic thermistor PTC is good for such applications. However the PTC is in a form of lump, so it is used as one of an isolated member of the thermostat. Since mechanical strength of the PTC is weaker than the other insulative ceramic, it is difficult to assemble them.

When a thermostat is assembled on a substrate having a resistor on it, its thickness is usually about 0.5 mm, and the substrate tends to crack under the fixing pressure. Thus it is difficult to manufacture a thermostat with high reliability.

It is an object of the present invention to provide a thermostat having a heater therein, which can made small and which is highly reliable and inexpensive in a manufacturing.

The object is achieved by a thermostat including two terminals to be connected with an external circuit, a fixed plate connected with one of said terminals and on which a static contact point is mounted, a resilient plate connected with the other of said two terminals and on which a movable contact point is mounted, a bimetal which is so deformed, when the temperature of the bimetal exceeds a predetermined temperature, to deform said resilient plate so that said movable contact point is separated from said static contact point, and a heater mounted in parallel with said fixed plate and said resilient plate, wherein said heater is formed by an electro-conductive film on an insulative film, incorporated in the thermostat.

The heater in the thermostat is a film, then its occupation volume is very small. Therefore, the heater can be included in the thermostat, in any small space.

Nevertheless all of the conductive elements in the housing are usually disposed without insulative covering, the insulation between the conductive elements and the heater can be achieved by using the insulative film, since the heater used in the present invention is formed on the insulative film.

The advantages of the present invention are:

1) Since the external shape of the thermostat is the same as that of the prior art thermostat, the thermostat can be used in the same manner.

2) Any modification of the design for the thermostat is unnecessary or small, and many components can be commonly used.

3) As the heater is included within a thermostat, the heating efficiency of the bimetal is increased.

4) As the heater is included within a thermostat, the difference of heat conductivity to outside due to the mounting is small and the thermostat is stable against the external disturbance.

5) As the heater is flexible, the heater is easy to handle.

BRIEF DESCRIPTION OF THE DRAWINGS

FIG. 6 is the block diagram of a thermostat with a heater, in a used state, of the present invention and the prior art.

DETAILED DESCRIPTION OF THE PREFERRED EMBODIMENT

Figure 1:
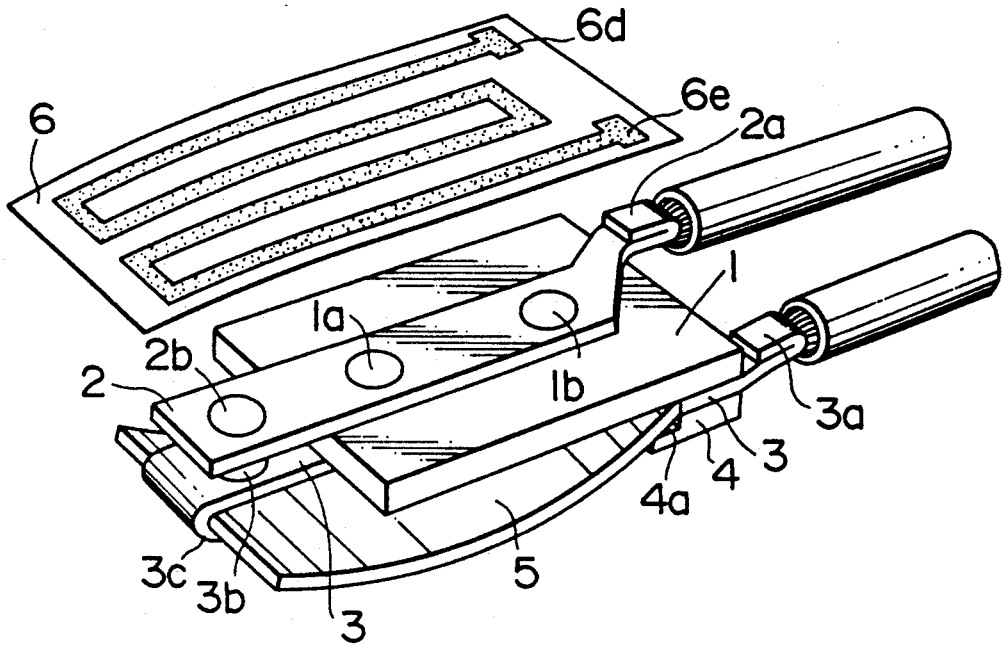
FIG. 1 is a perspective view of a thermostat according to the present invention, where the thermostat housing is removed.
Figure 2:
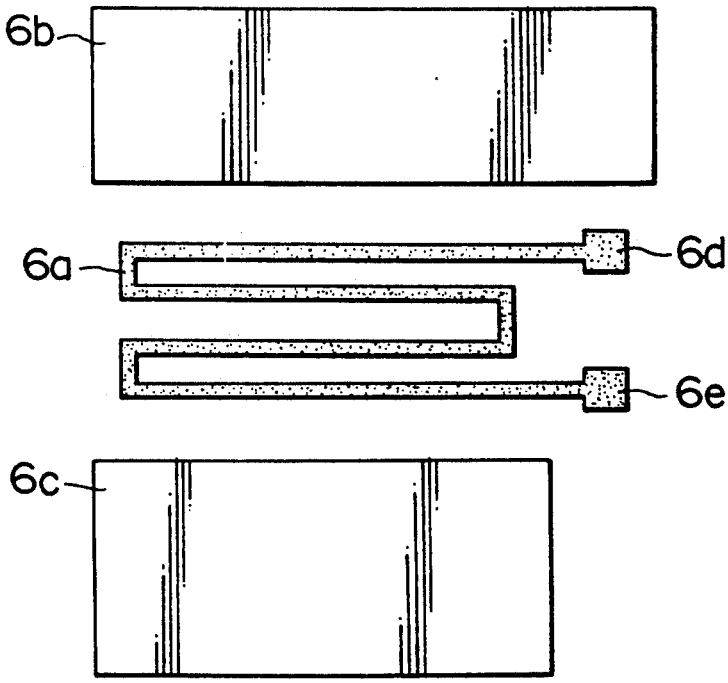
FIG. 2 is an exploded front view of a filmy heater used in the thermostat according to the present invention.
Figure 3:
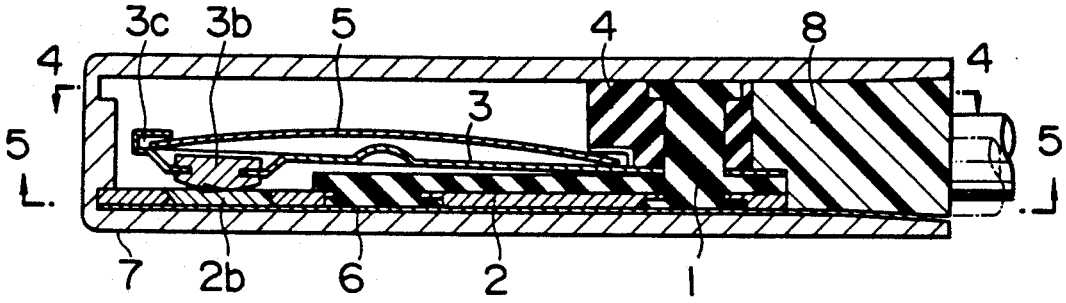
FIG. 3 is sectional view of the thermostat according to the present invention.
Figure 4:
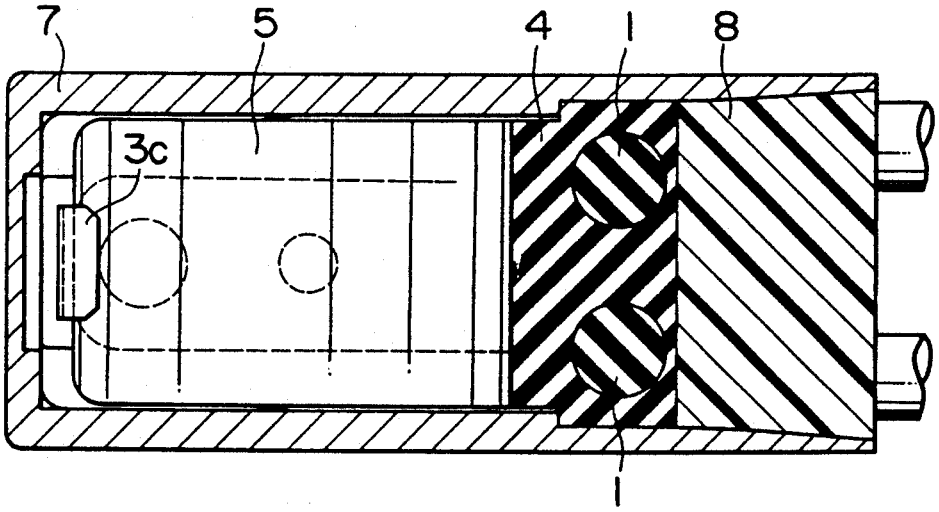
FIG. 4 is a view taken along the line A—A of FIG. 3.
Figure 5:
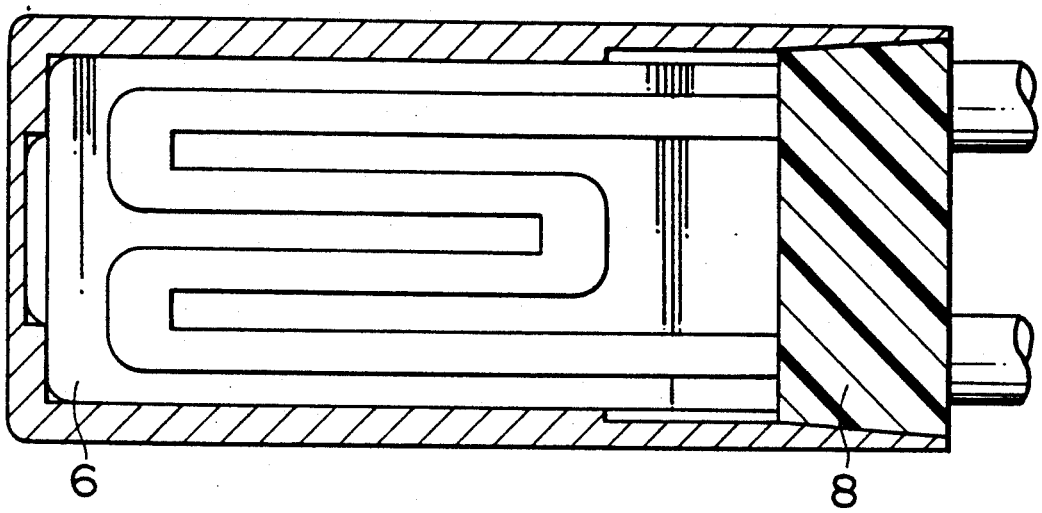
FIG. 5 is a view taken along the line B—B of FIG. 3.
Figure 5:
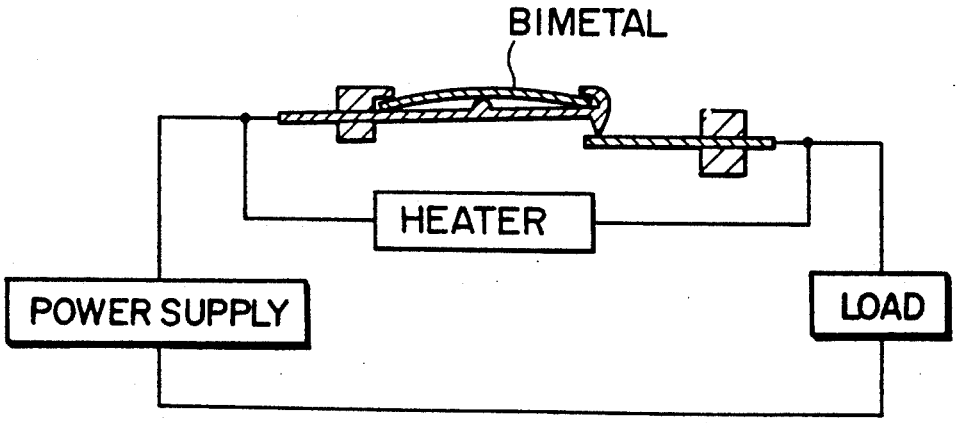

An embodiment of a thermostat with a filmy heater according to the present invention is described with reference to FIGS. 1 to 6.

A fixed plate 2 is disposed on one surface of an insulative substrate 1, and a resilient plate 3 is disposed on the other surface of the substrate 1.

The fixed plate 2 is fixed by means of projections 1*a* and 1*b* mounted on the substrate 1. A terminal 2*a* to be connected with an external circuit is provided at one end of the fixed plate and a static contact point 2*b* is made at its other end.

The resilient plate 3 is made of resiliently deformable material and is held between an insulator 4 and the substrate 1. A terminal 3*a* to be connected with the external circuit is also provided at one end of the resilient plate 3 and a movable contact point 3*b* is made at its other end.

A bimetal 5 is disposed between a folded portion 3*c* at the end of the resilient plate 3, near to the movable contact point 3*b*, and a recess 4*a* in the insulator 4.

The bimetal 5 varies its curvature, when the temperature of the bimetal 5 exceeds a predetermined temperature to deform the resilient plate 3, so that the static contact point 2*b* and the movable contact point 3*b* are separated from each other. When the temperature of the bimetal 5 is lower than the predetermined temperature, the bimetal 5 deforms the resilient plate 3, so that the static contact point 2*b* and the movable contact point 3*b* come into contact with each other.

The terminals 2*a* and 3*a* are connected to conductors for connection to the external circuit.

A heater 6 is filmy heater which is a linear electro-conductive polyimide film 6*a* held between insulative polyimide films 6*b* and 6*c*.

On one surface of the insulative polyimide films 6*b* and 6*c*, an adhesive is applied. An electro-conductive polyimide film 6*a* is placed on the insulative polyimide film 6*b*, so that the conductive polyimide film 6*a* is fixed on the insulative polyimide film 6*b*. The conductive polyimide film 6*a* is covered by the other insulative polyimide film 6*c*, except both ends 6*d* and 6*e*, so that both surfaces of the conductive polyimide film 6*a* are covered by the insulative films.

Conductive paste applied on both the ends 6*d* and 6*e* form electrodes.

The heater 6 is fixedly mounted on the substrates 1 at its fixed plate 2 side, by adhesive applied on the insulative polyimide film 6*c*. The heater 6 is bent, if necessary, so that the electrodes formed at the ends 6*d* and 6*e* contact with the terminals 2*a* and 3*a*, respectively.

A thermostat assembly including the heater 6 is inserted into a housing 7 and the portion near the terminals 2*a* and 3*a* is filled with synthetic resin 8.

Polyimide film is the best for a conductive film, however polyester film, polyether sulphon (PES), polyether etherketone (PEEK) and the like may be also used.

A resistor as a heater can be formed by cutting a conductive film into a line shape, providing an adjustment to a necessary electrical resistance value and a current value.

Polyimide film is also the best for the insulative film, however polyester film, PES, PEEK and the like may be used.

In this embodiment, an insulative film which has adhesive only on its one side is used, while a film having adhesive on both sides or conductive film with adhesive may be used in accordance with a structure of the thermostat.

When film material (such as disclosed in "Electronique-Ceramics" (Japan) Vol. 9, 1986, pages 61–66) has a specific resistance which rapidly increases, when its temperature exceeds a predetermined temperature, the thermostat can be designed so as to hold its temperature by itself.

What is claimed is:

1. A thermostat with a filmy heater including:

two terminals to be connected with an external circuit, a fixed plate connected with one of said terminals and on which a static contact point is mounted, a resilient plate is connected with the other of said two terminals and on which a movable contact point is mounted, a bimetal which is so deformed, when the temperature of said bimetal exceeds a predetermined temperature, to deform said resilient plate so that said movable contact point is separated from said static contact point, and said filmy heater mounted in parallel with said fixed plate and said resilient plate, wherein said heater is comprised of an electro-conductive film on an insulative film, said electro-conductive film is cut into a line shape and its resistance adjusted and is covered with an insulative film, said electro-conductive film and said insulative film are made from polyimide film.

2. A thermostat with a filmy heater, including:

two terminals to be connected with an external circuit, a fixed plate connected with one of said terminals and on which a static contact point is mounted, a resilient plate is connected with the other of said two terminals and on which a movable contact point is mounted, a bimetal which is so deformed, when the temperature of said bimetal exceeds a predetermined temperature, to deform said resilient plate so that said movable contact point is separated from said static contact point, and said filmy heater mounted in parallel with said fixed plate and said resilient plate, wherein said heater is comprised of an electro-conductive film on an insulative film, wherein said electro-conductive film is made of material having a specific resistance which rapidly increases, when temperature of said electro-conductive film exceeds a predetermined temperture, said electro-conductive film is cut into a line shape and its resistance adjusted and is covered with an insulative film, said insulative filmis made from polyimide film.

* * * * *